US007601084B2

(12) United States Patent
Martin

(10) Patent No.: US 7,601,084 B2
(45) Date of Patent: Oct. 13, 2009

(54) ARROW LAUNCHED MEDIA RESERVOIR

(76) Inventor: John C. Martin, 1131 Lyonhurst, Birmingham, MI (US) 48009

( * ) Notice: Subject to any disclaimer, the term of this patent is extended or adjusted under 35 U.S.C. 154(b) by 275 days.

(21) Appl. No.: 11/470,669

(22) Filed: Sep. 7, 2006

(65) Prior Publication Data

US 2007/0026978 A1 Feb. 1, 2007

Related U.S. Application Data

(63) Continuation-in-part of application No. 11/153,136, filed on Jun. 15, 2005.

(60) Provisional application No. 60/580,618, filed on Jun. 17, 2004, provisional application No. 60/727,469, filed on Oct. 17, 2005, provisional application No. 60/762,652, filed on Jan. 27, 2006, provisional application No. 60/771,155, filed on Feb. 7, 2006, provisional application No. 60/742,298, filed on Dec. 5, 2005.

(51) Int. Cl.
*F42B 6/04* (2006.01)
*F42B 6/08* (2006.01)

(52) U.S. Cl. ..... 473/578; 473/581; 473/582

(58) Field of Classification Search ..... 473/578, 473/581, 582

See application file for complete search history.

(56) References Cited

U.S. PATENT DOCUMENTS

| | | | | | |
|---|---|---|---|---|---|
| 3,190,654 | A * | 6/1965 | Ross | 273/378 |
| 3,528,662 | A * | 9/1970 | Lloyd et al. | 473/577 |
| 3,672,677 | A * | 6/1972 | Moore | 473/578 |
| 4,881,743 | A * | 11/1989 | Fiorenzo | 473/577 |
| 5,669,836 | A * | 9/1997 | Hill | 473/574 |
| 6,142,895 | A * | 11/2000 | Jason | 473/577 |
| 6,159,117 | A * | 12/2000 | Chan | 473/574 |
| 6,450,905 | B1 * | 9/2002 | Edlund | 473/581 |

* cited by examiner

*Primary Examiner*—John Ricci
(74) *Attorney, Agent, or Firm*—Howard & Howard Attorneys PLLC

(57) ABSTRACT

An arrow (20) having an arrowhead assembly (30) attached thereto is provided for marking a remote location with a marking media (22). The marking media (22) is preferably in the form of a paint ball or a scent ball. The arrowhead assembly (30) includes a media reservoir (46) defining a cavity (52) and a plurality of supports (54) extending outward from the media reservoir (46) along a longitudinal axis (L). The supports (54) secure the marking media (22) within the cavity (52) in a press-fit connection. In one embodiment, a cap (62) and a resilient nose cone (70) are attached to the media reservoir (46), surrounding the marking media (22), to prevent damage to a target upon impacting the target.

41 Claims, 8 Drawing Sheets

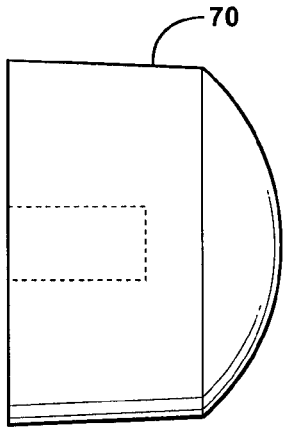
FIG - 13
FIG - 14
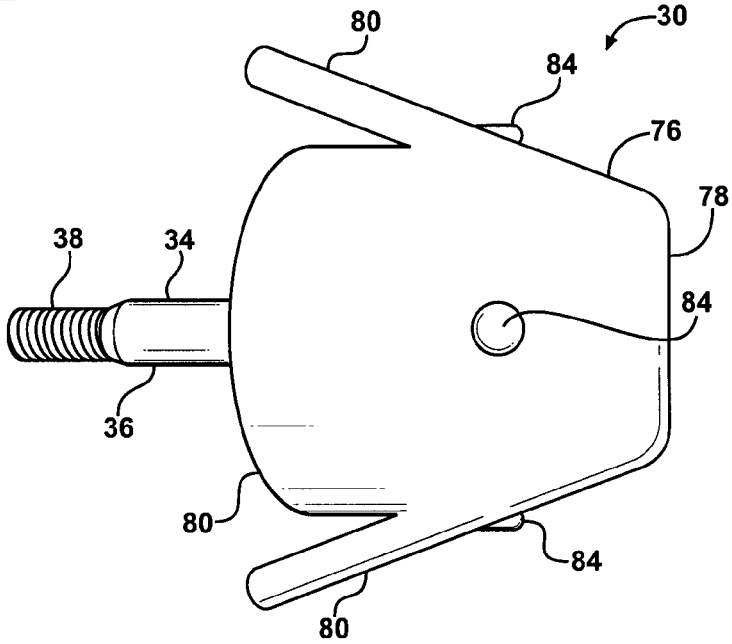
FIG - 15
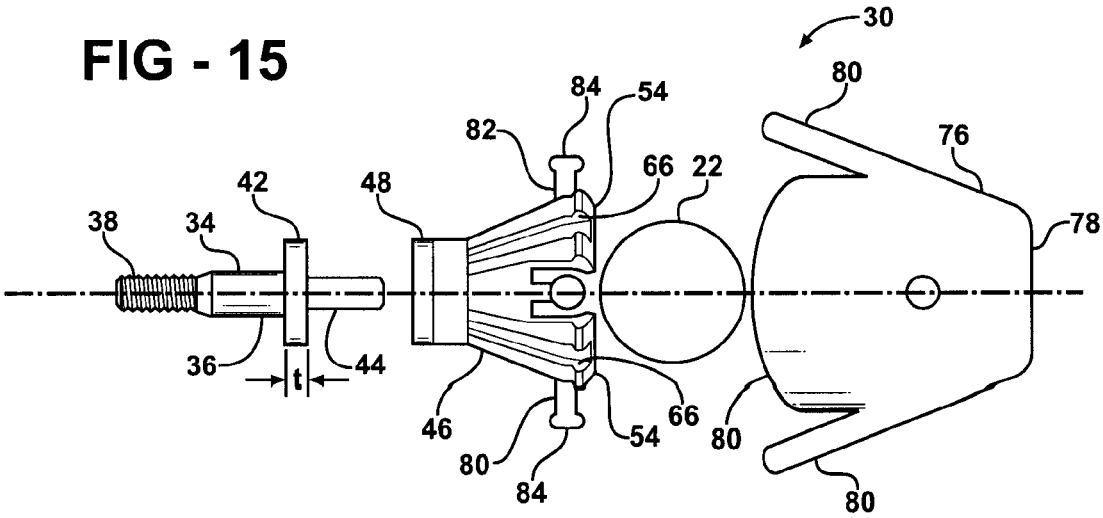

ARROW LAUNCHED MEDIA RESERVOIR

CROSS REFERENCE TO RELATED APPLICATION

This application is a continuation-in-part of prior non-provisional patent application Ser. No. 11/153,136 filed Jun. 15, 2005, which claims the benefits of U.S. provisional patent application Ser. No. 60/580,618 filed on Jun. 17, 2004; and also claims the benefits of U.S. provisional patent application Ser. No. 60/727,469 filed on Oct. 17, 2005, U.S. provisional patent application Ser. No. 60/742,298 filed on Dec. 5, 2005, U.S. provisional patent application Ser. No. 60/762,652 filed on Jan. 27, 2006, and U.S. provisional patent application Ser. No. 60/771,155 filed on Feb. 27, 2006, the advantages and disclosure of each are hereby incorporated by reference.

BACKGROUND OF THE INVENTION

1. Field of the Invention

The subject invention generally relates to an arrow, and more specifically to an arrowhead assembly attached to the arrow for remotely delivering a marking media to a remote location.

2. Description of the Prior Art

Many millions of people around the world enjoy the sport of archery. Of these, over four (4) million hunters in the United States alone take to the field each year to hunt big game, i.e., deer, elk, etc., or to practice their shooting skills by "stump shooting", i.e., shooting at trees, fence posts, tree stumps, etc.

Those archers who enjoy stump shooting are currently restricted to using arrowheads that are not effective in providing immediate feedback regarding shot placement or, if the feedback is rapid, the archer is faced with the time consuming task of trying to extract the arrowhead from the woodland target.

U.S. Pat. No. 6,142,895 (the '895 patent) discloses an arrow having a marking head for providing feedback regarding shot placement of the arrow. The arrow includes a shaft and a receiving plug attached to one end of the shaft. An arrowhead connector is in threaded engagement with the receiving plug, and supports a base thereon. The base is formed of a hard rubber or plastic and includes a concavity in a front end thereof for seating a paint ball therein. An adhesive secures the paint ball to the base. Upon the arrow impacting the surface, the paint ball ruptures, marking the target with the paint.

For those archers who enjoy the sport of bow hunter, the use of a marking media, such as a "scent", is a common tool. The scent can be in the form of a cover scent, e.g., skunk scent, fox urine, etc., meant to mask the scent of the hunter, or alternatively, it may be in the form of an attractor scent, e.g., a doe-in-heat scent, etc., designed to lure a buck to a certain spot in the forest where the buck believes a doe may be ready to mate.

Currently, the preferred method of delivering attractor scents involves the hunter going to a spot in the forest and "dropping" scent at the location. The method of dropping the scent generally takes the form of applying the scent to a felt pad and leaving the pad suspended from a tree branch or by simply placing the pad on the ground. The risk associated with this method of dropping the scent is that while the hunter is placing the attractor scent, by the very nature of being at the location, the hunter is also leaving their human scent along the way. Human scent is not an attractor scent for most game species, and actually tends to repel most game species.

Alternative methods of delivering the attractor scents have been developed. One such method includes incorporating a scent with an arrow, allowing the hunter to launch the arrow into the location without actually entering the location, thereby permitting the hunter to avoid leaving their human scent at the location where the attractor scent is applied. This method of delivering the scent may be referred to as an airborne delivery method. An example of an arrow utilized in such an airborne delivery method is disclosed in U.S. Pat. No. 4,881,743 (the '743 patent) to Fiorenzo, titled "Scent Head Arrow".

Alternatively, U.S. Pat. No. 5,303,496 (the '496 patent) to Kowalkowski, titled "Scent Distributing Method For Hunters", discloses a method of delivering a scent by encapsulating the scent in a plastic or gelatin walled pellet. The pellet may be in the form of a scent ball, similar to a paint ball utilized in a compressed air gun, and delivered by an arrow as described above in the '895 patent. Upon the arrow impacting a surface, the scent ball ruptures, spreading the desired scent onto the surface.

The arrow described in the '895 patent is capable of delivering a marking media, such as the paint ball or the scent ball, to a remote location. However, the marking media must be attached to the arrow by an adhesive before use, allowing sufficient time for the adhesive to dry. This is both time consuming and messy. Additionally, care must be taken to protect the arrow once the marking media is attached thereto to prevent the marking media from rupturing while transporting the arrow prior to use.

SUMMARY OF THE INVENTION AND ADVANTAGES

The subject invention provides an arrow for remotely delivering a marking media to a location. The arrow comprises a shaft having a nock end and extending along a longitudinal axis to an opposing distal end. A media reservoir includes a base attached to the distal end of the shaft, and defines a cavity. A plurality of supports extends outwardly from the base of the media reservoir along the longitudinal axis. The plurality of supports secures the marking media within the cavity of the media reservoir, between the plurality of supports, in a press-fit connection.

Accordingly, the subject invention provides an arrow capable of securing the marking media, such as a paint ball or a scent ball, within the cavity by simply pressing the marking media into the cavity between the supports, and does not require the use of an adhesive. Therefore, the marking media may be secured within the cavity immediately before use, without the need to pre-assemble the arrow and the marking media with an adhesive, nor requiring sufficient time for the adhesive to dry. Additionally, since the marking media is secured immediately before use, the marking media may be stored in a protective sleeve, thereby eliminating the need to protect the assembled arrow and marking media during transport prior to use.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 13 is a cross sectional side view of a cone;

FIG. 14 is a side view of an alternative embodiment of the arrowhead assembly;

FIG. 15 is an exploded side view of the alternative embodiment of the arrowhead assembly;

DETAILED DESCRIPTION OF THE INVENTION

Figure 1:
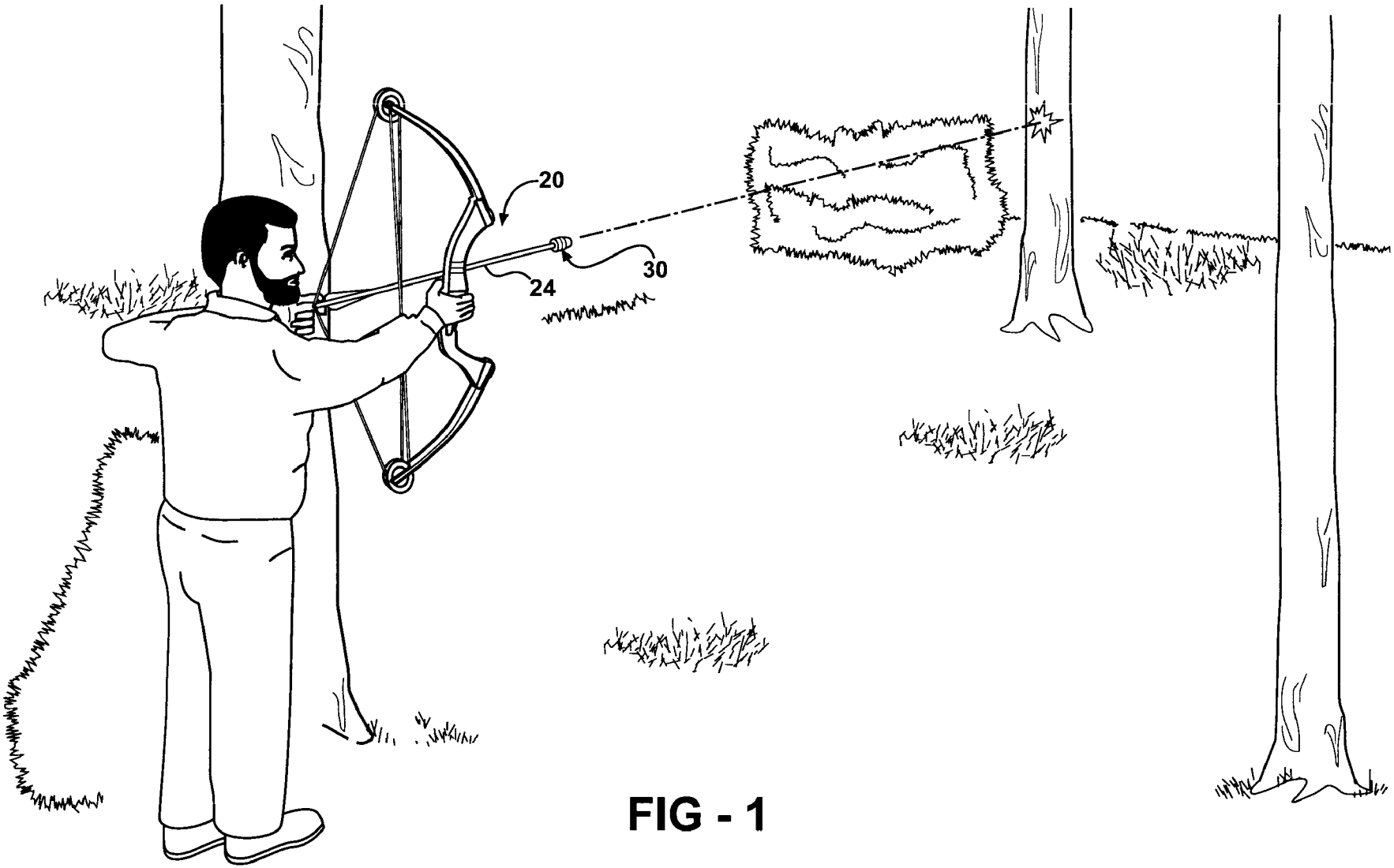
FIG. 1 is a perspective view of an archer launching an arrow.

Referring to the Figures, wherein like numerals indicate corresponding parts throughout the several views, an arrow is generally shown at 20. Referring to FIG. 1, the arrow 20 remotely delivers a marking media 22 to a location. The marking media 22 is preferably a paint ball, such as is commonly utilized with a compressed air gun, or a scent ball, such as described in U.S. Pat. No. 5,303,496 to Kowalkowski, titled "Scent Distributing Method For Hunters". The marking media 22 typically includes a liquid, a gel, a powder, or some other similar medium encapsulated by a container, or in the case of the paint ball or scent ball a hardened outer shell, to hold the medium until ruptured and dispersed. The marking media 22 (preferably either the paint ball or the scent ball) preferably includes a spherical shape having a diameter of 0.68 inches, i.e., a 68 caliber ball. It should be understood that the marking media 22 may include a diameter other than the preferred diameter of 0.68 inches and a shape other than the preferred spherical shape, and still fall within the scope of the claims.

Referring to FIG. 2The arrow 20 includes a shaft 24 having a nock end 26. The shaft 24 extends from the nock end 26 along a longitudinal axis L to an opposing distal end 28. An arrowhead assembly 30 is attached to the distal end 28 of the shaft 24. Fletching 32 is attached to the shaft 24 near the nock end 26 of the shaft 24.

Figure 3:
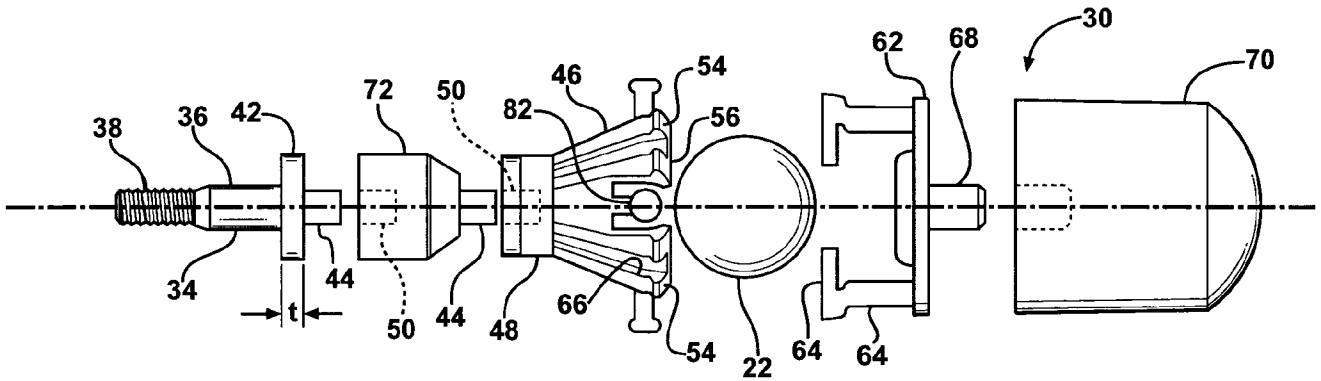
FIG. 3 is an exploded side view of an arrowhead assembly.
Figure 4:
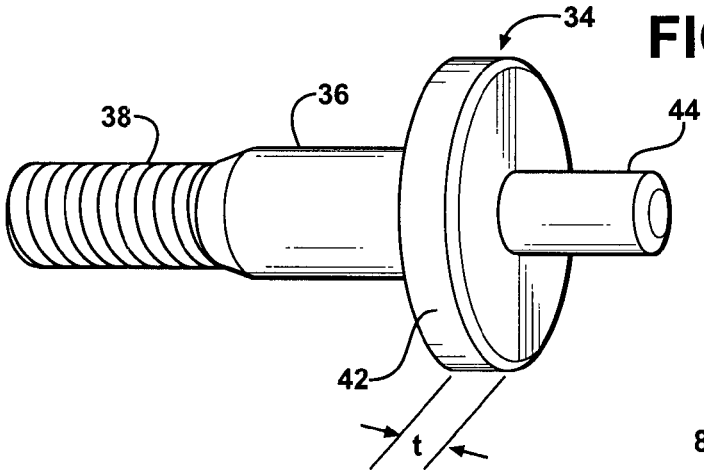
FIG. 4 is perspective view of an arrowhead connector.
Figure 5:
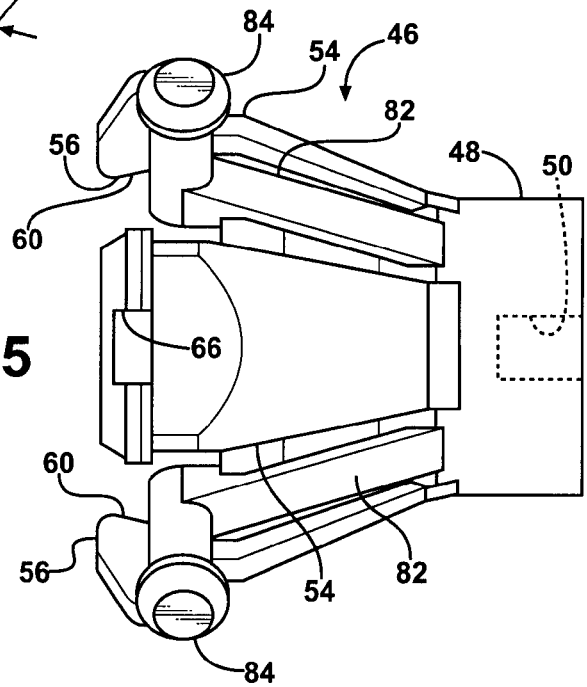
FIG. 5 is a side view of a media reservoir.
Figure 6:
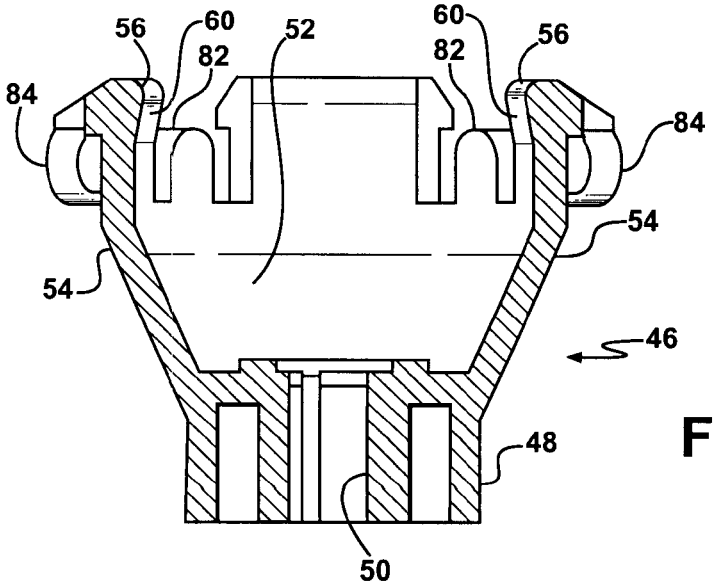
FIG. 6 is a cross sectional view of the media reservoir along cut line 6-6 shown in FIG. 5.
Figure 7:
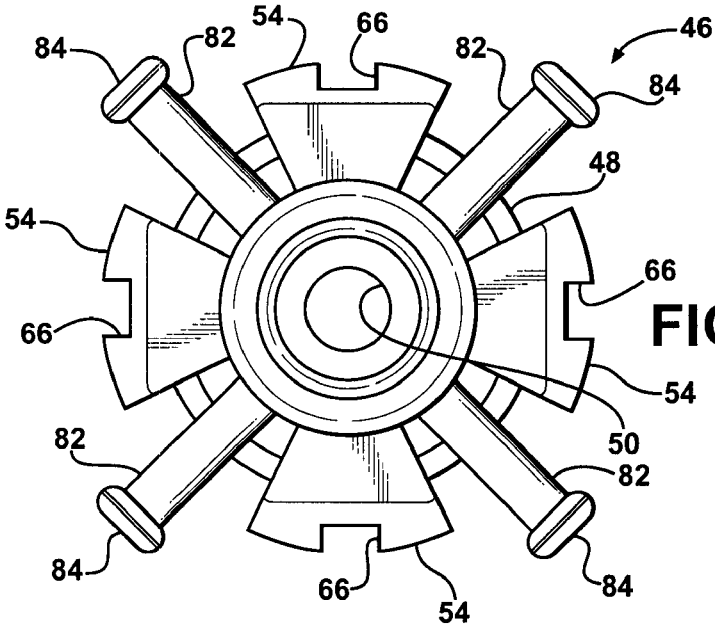
FIG. 7 is a front view of the media reservoir.
Figure 8:
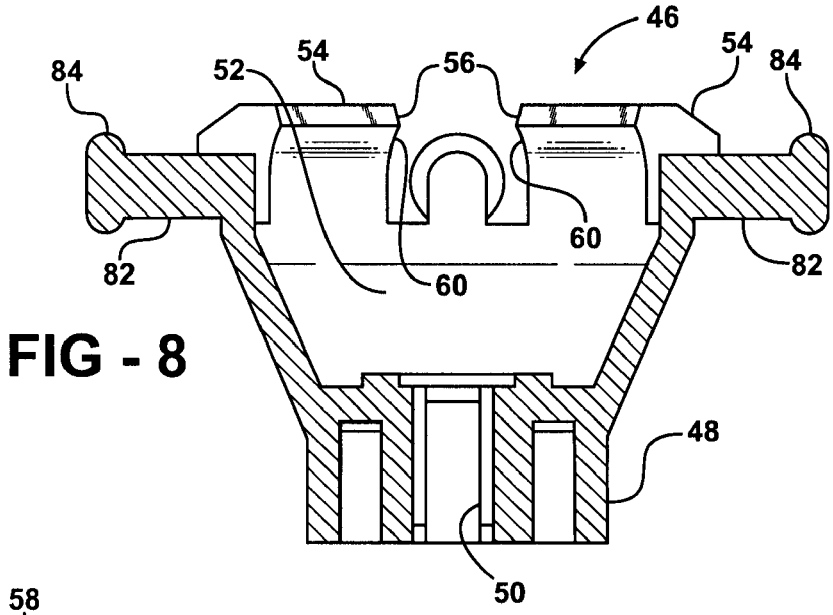
FIG. 8 is a cross sectional view of the media reservoir along cut line 8-8 shown in FIG. 7.

Also referring to FIGS. 3 and 4, the arrow 20 includes an arrowhead connector 34 interconnecting the shaft 24 of the arrow 20 and the arrowhead assembly 30. Preferably, and as shown in the Figures, the arrowhead connector 34 includes an elongate portion 36 having a threaded end 38 for threaded insertion into a receiving plug 40 (often referred to as an arrow insert) disposed within the distal end 28 of the shaft 24. A flange 42 extends radially outward from the elongate portion 36. A peg 44 is concentric with the elongate portion 36 and extends outward from the flange 42. The arrowhead connector 34 is preferably manufactured from a durable material to withstand the impact during use and permit re-use of the arrowhead connector 34. Preferably, the arrowhead connector 34 is aluminum, or a similar metal. Additionally, when manufactured from an aluminum material, the flange 42 of the arrowhead connector 34 preferably includes a thickness t of at least one tenth of an inch, so as to not break during impact, however, the thickness t of the flange 42 may vary depending upon specific design considerations. It should be understood that the arrowhead connector 34 may be configured otherwise than described above and shown in the Figures and still fall within the scope of the claims.

Figure 2:
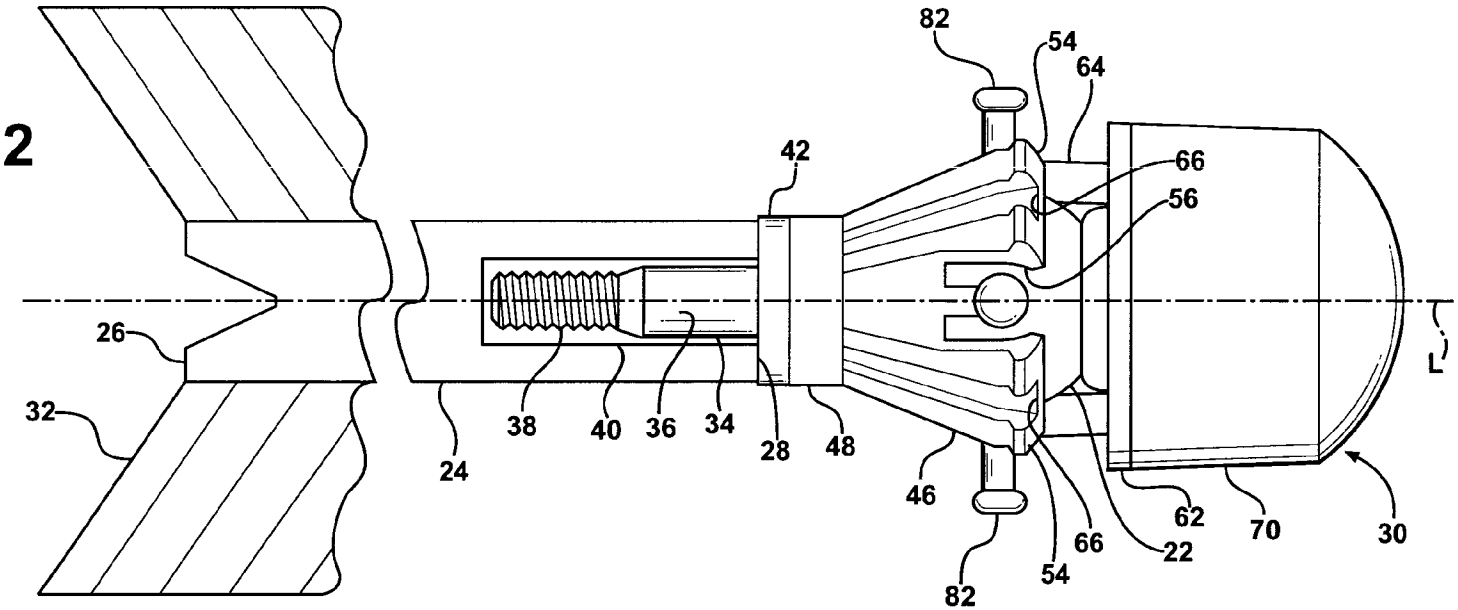
FIG. 2 is a side view of the arrow.

Referring to FIGS. 2, 3, and as best shown in FIGS. 5 through 8, the arrowhead assembly 30 further includes a media reservoir 46. The media reservoir 46 includes a base 48 connected to the arrowhead connector 34 near the distal end 28 of the shaft 24. The base 48 is supported by the flange 42 of the arrowhead connector 34. The base 48 of the media reservoir 46 further includes a bore 50 for slideably engaging the peg 44 of the arrowhead connector 34 in a push fit connection, thereby connecting the arrowhead connector 34 and the media reservoir 46, and allowing for easy replacement of the media reservoir 46 after each use, while also permitting re-use of the arrow 20. Other mechanical connections may also be utilized to secure the media reservoir 46 to the arrowhead connector 34 other than specifically described herein. The connection between the arrowhead connector 34 and the media reservoir 46 being interchangeable with other components described below for situating the other components between the arrowhead connector 34 and the media reservoir 46 if so desired. The media reservoir 46 defines a cavity 52 for supporting the marking media 22. At least one support 54, but preferably a plurality of supports 54 extends outwardly from the base 48 of the media reservoir 46, along the longitudinal axis L. The supports 54 secure the marking media 22 within the cavity 52 of the media reservoir 46 between the supports 54 in a press-fit connection. Accordingly, the marking media 22 is pressed into the cavity 52 between the supports 54, with the supports 54 holding the marking media 22 in place. Each of the plurality of supports 54 include a lip 56 for engaging the marking media 22. The lips 56 on the supports 54 assist in retaining the marking media 22 between the supports 54.

As noted above, the marking media 22 preferably includes a spherical body defining a diameter of 0.68 inches. As such, the lips 56 on the supports 54 are spaced from the base 48 a distance greater than one-half the diameter of the spherical body, i.e., greater than 0.34 inches. Each of the lips 56 is disposed a distance less than the diameter of the spherical body from any other of the lips 56, i.e., less than 0.68 inches. This ensures that the lips 56 extend beyond the largest portion of the marking media 22, trapping the marking media 22 between the base 48 of the media reservoir 46 and the lips 56 on the support 54. Accordingly, when pressing the marking media 22 into the cavity 52, it is necessary for the supports 54 and/or the outer wall of the marking media 22 to flex to allow entry of the marking media 22 into the cavity 52. After which, the supports 54 and/or the outer wall of the marking media 22 return to their respective original and natural shape. It should be understood that the scope of the claims is not limited to the exact dimensions of the preferred embodiment described herein.

Additionally, the supports 54 include an interior curvilinear surface 60 complimentary to the spherical body of the marking media 22 to cradle the spherical body of the marking media 22 between the curvilinear surfaces of the supports 54. It should be understood that if the marking media 22 includes a shape other than spherical, the supports 54 may include an interior surface complimentary thereto.

Upon the arrow 20 impacting the target, inertia drives the flange 42 of the arrowhead connector 34 into the base 48 of the media reservoir 46, rupturing the marking media 22 and fracturing the media reservoir 46. In so doing, if the marking media 22 is a paint ball, the marking media 22 releases paint, which splatters onto the target to indicate the shot placement of the arrow 20. If the marking media 22 is a scent ball, scent splatters onto the target to emanate therefrom. It should be understood that the media reservoir 46 is destroyed by the impact and not reusable. However, the arrow 20 and the arrowhead connector 34 may be retrieved and reused with a new arrowhead assembly 30 and a new marking media 22.

Figure 11:
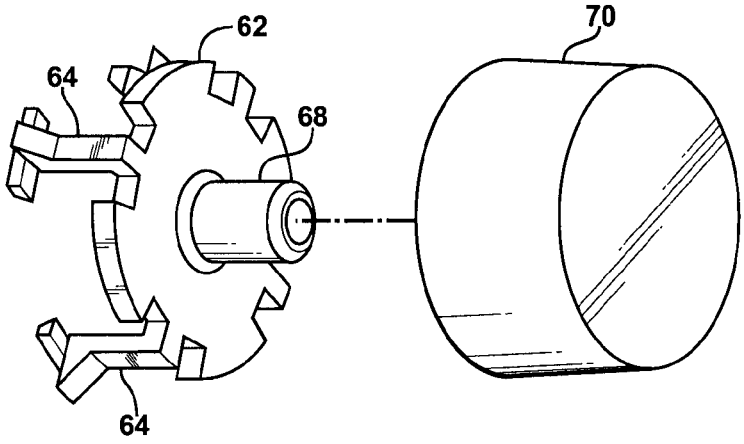
FIG. 11 is a perspective view of a cap.
Figure 12:
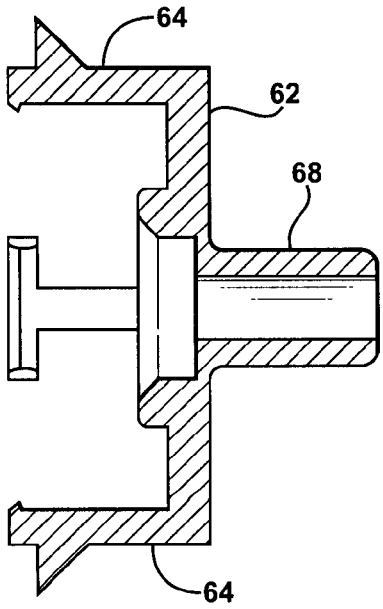
FIG. 12 is a cross sectional side view of the cap.
Figure 16:
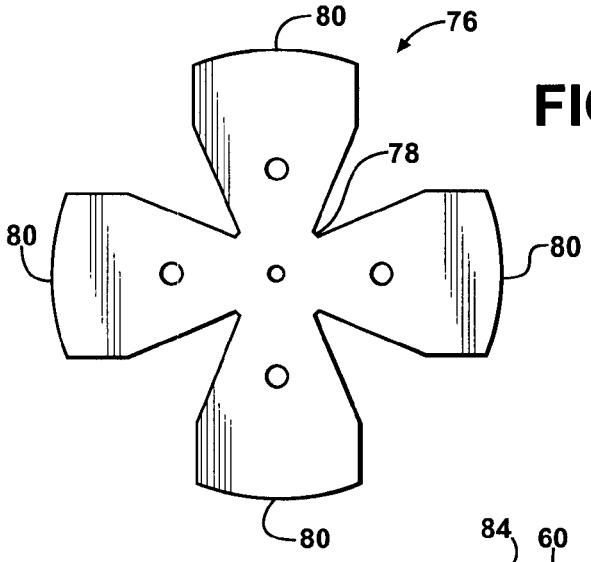
FIG. 16 is a plan view of a pad utilized in the alternative embodiment of the arrowhead assembly.

Referring to FIGS. 2 and 3, and as best shown in FIGS. 11 and 12, a cap 62 may optionally be attached to the media reservoir 46. When the cap 62 is attached to the media reservoir 46, the cap 62 cooperates with the media reservoir 46 to further define the cavity 52 between the media reservoir 46 and the cap 62, with the marking media 22 disposed and surrounded by the base 48 of the media reservoir 46, the supports 54, and the cap 62. The cap 62 includes a plurality of detents 64, which extend toward the supports 54. Each of the supports 54 defines a recess 66 for receiving one of the detents 64 in a snap fit connection. The cap 62 includes a stud 68 extending outward along the longitudinal axis L. Also referring to FIG. 13, a nose cone 70 is attached to the cap 62 by frictional engagement with the stud 68 on the cap 62. The nose cone 70 is disposed opposite the cavity 52, and absorbs energy upon impacting a surface. The nose cone 70 includes a resilient material to bounce off or otherwise dissipate energy from the impact with the target. Accordingly, the arrow 20, when equipped with the cap 62 and the nose cone 70, permits targeting of wild game animals, without the fear of injuring or damaging the game animal.

Figure 9:
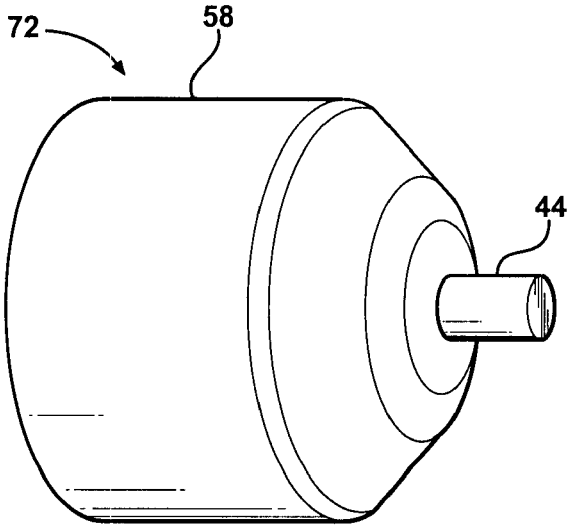
FIG. 9 is a perspective view of an energy dissipating device.
Figure 10:
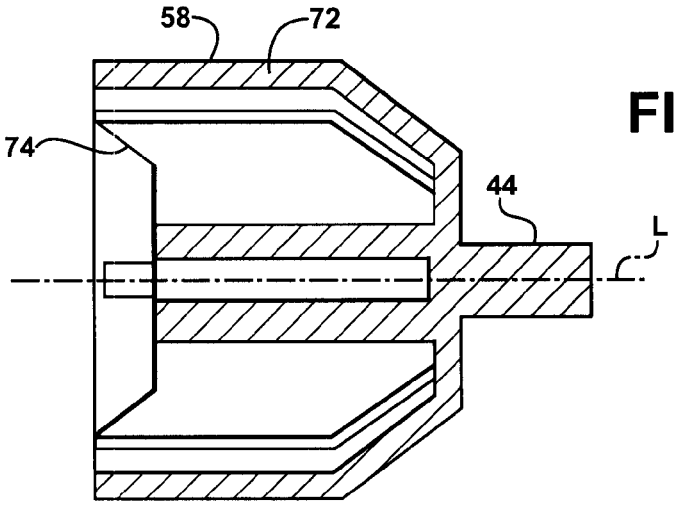
FIG. 10 is a cross sectional view of the energy dissipating device.

Referring to FIG. 3, and as best shown in FIGS. 9 and 10, the arrowhead assembly 30 may further include a frangible energy dissipating device 72. The energy dissipating device 72 reduces an amount of energy transmitted to the shaft 24 of the arrow 20 upon impact, thereby protecting the shaft 24 from damage and permitting re-use of the arrow 20. The energy dissipating device 72 is preferably disposed between the arrowhead connector 34 and the media reservoir 46. The energy dissipating device 72 includes an outer wall 58 and at least one vein 74 extending inward toward the longitudinal axis L from the outer wall 58 for fracturing the outer wall 58 in response to the shaft 24 advancing forward into the energy dissipating device 72. The energy dissipating device 72 includes a bore 50 identical to the bore 50 defined by the media reservoir 46 for disposition over the peg 44 on the arrowhead connector 34, thereby interconnecting the arrowhead connector 34 and the energy dissipating device 72 in a push fit connection. The energy dissipating device 72 further includes a peg 44 identical to the peg 44 on the arrowhead connector 34 for disposition within the bore 50 defined by the media reservoir 46, thereby interconnecting the energy dissipating device 72 and the media reservoir 46 in a push fit connection. Accordingly, the arrowhead assembly 30 utilizes the same type of connection between the arrowhead connector 34 and the media reservoir 46, as between the arrowhead connector 34 and the energy dissipating device 72, as well as between the energy dissipating device 72 and the media reservoir 46, thereby permitting the archer to choose whether or not to use the energy dissipating device 72 in the arrowhead assembly 30. Upon impact, the flange 42 of the arrowhead connector 34 advances forward into the energy dissipating device 72, thereby crushing the vein 74. In so doing, a predetermined amount of energy is dissipated from the arrow 20, thereby reducing the amount of energy the shaft 24 would otherwise have to withstand. It should be understood that the outer wall 58 may fracture as a result of the flange 42 crushing the vein 74.

Referring to FIGS. 14 through 17, in a first alternative embodiment, a pad 76 is attached to the media reservoir 46. The pad 76 cooperates with the media reservoir 46 to further define the cavity 52 between the media reservoir 46 and the pad 76. Preferably, and as shown in the Figures, the pad 76 includes a central portion 78 and a plurality of wings 80 extending from the central portion 78. The media reservoir 46 includes a plurality of posts 82 extending outward from the base 48 along the longitudinal axis L. The posts 82 include an upstanding ridge 84 disposed on each of the posts 82 for securing the wings 80 to the posts 82.

The pad 76 includes an absorbent material, such as a felt or cotton material for absorbing the marking media 22 upon impact. The marking media 22 in the first alternative embodiment includes a sent ball, as described above. Accordingly, the scent ball is disposed within the cavity 52, surrounded by the base 48, the supports 54, and the pad 76. The wings 80 of the pad 76 wrap around the scent ball and the supports 54, covering a portion of the supports 54 and attaching to the posts 82 of the media reservoir 46. It should be understood that the pad 76 may include other materials capable of absorbing the scent from the scent ball and may be shaped otherwise than specifically described herein.

Figure 17:
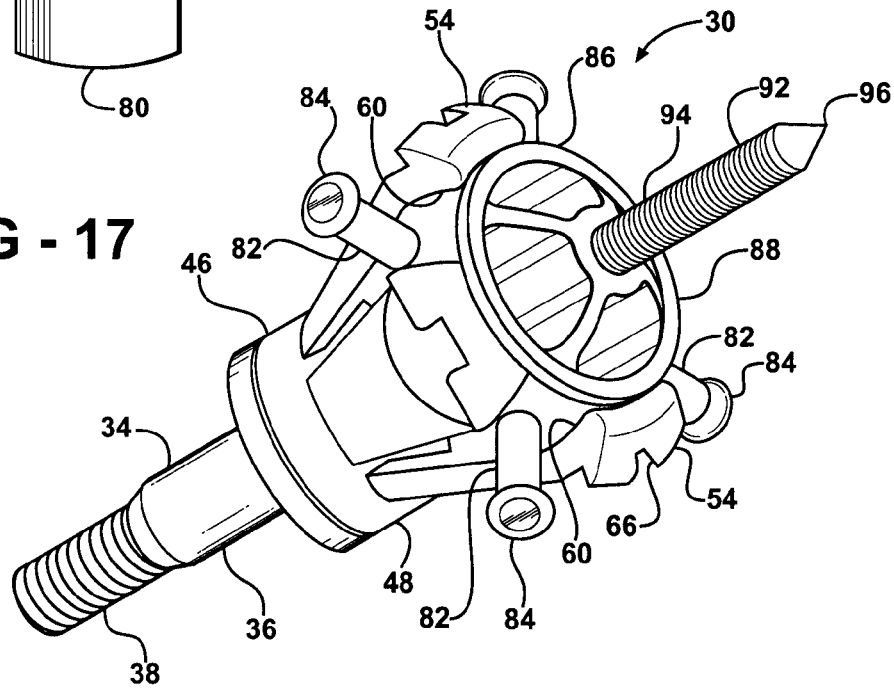
FIG. 17 is a perspective view of a second alternative embodiment of the arrowhead assembly.
Figure 18:
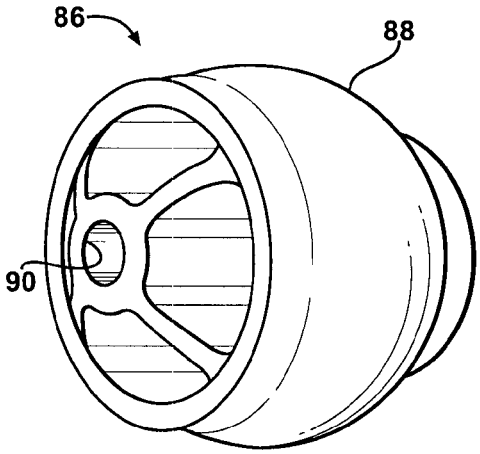
FIG. 18 is a perspective view of an attachment device utilized in the second alternative embodiment of the arrowhead assembly.
Figure 19:
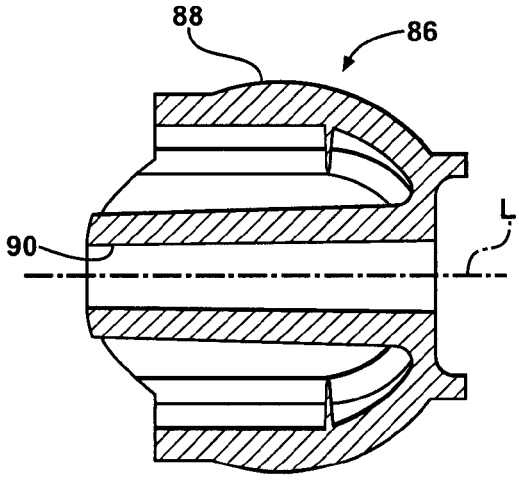
FIG. 19 is a cross sectional side view of the attachment device.

Referring to FIGS. 17 through 19, in a second alternative embodiment, an attachment device 86 is disposed within the cavity 52 for attaching the pad 76 to a surface. The attachment device 86 is disposed within the cavity 52 in lieu of the marking media 22. The pad 76 is attached to the posts 82 of the media reservoir 46 as described in the first alternative embodiment. The attachment device 86 includes a spherical housing 88 supported between the supports 54 in the media reservoir 46, similar to the paint ball or the scent ball as described above. The attachment device 86 defines a central bore 90 through the spherical housing 88, and includes a spike 92 having a shank 94 partially disposed within the central bore 90 and presenting a point 96 extending outward from the spherical housing 88. The pad 76 includes an opening 98 for passing the shank 94 of the spike 92 therethrough. Accordingly, upon impact with the target, the spike 92 will penetrate and stick to the target, pinching the pad 76 between the housing 88 of the attachment device 86 and the target. In the second alternative embodiment, the marking media 22 includes a liquid scent applied directly to the pad 76 just prior to launching the arrow 20.

Figure 20:
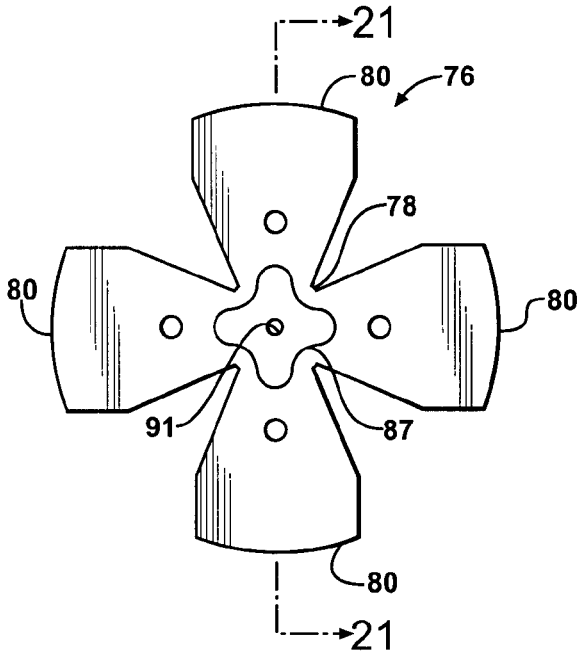
FIG. 20 is a side view of an alternative embodiment of the attachment device on the pad shown in FIG. 16.
Figure 21:
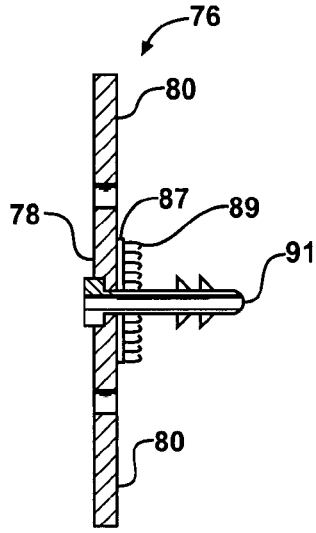
FIG. 21 is a cross sectional side view taken along cut line 21-21 shown in FIG. 20.

Referring to FIGS. 20 and 21, an alternative embodiment of the attachment device 86 is disclosed. This alternative embodiment of the attachment device is intended for attaching the pad 76 to a fur coat of an animal. The alternative embodiment of the attachment device 86 includes an attachment sheet 87, coupled to the central portion 78 of the pad 76. The attachment sheet 87 includes a plurality of hooks 89, and is preferably a hook portion of a loop and hook connection, commonly sold under the trademark VELCRO, by Velcro Industries B.V. The attachment sheet 87 may be coupled to the pad 86 by an adhesive, or alternatively may be sewn onto the pad 86. It should be understood that the attachment sheet 87 may be coupled to the pad by some other method not specifically enumerated herein. An attachment nail 91 extends through the pad 76 and the attachment sheet 87. The attachment nail 91 is long enough to penetrate the fur of the animal, yet short enough so as not to penetrate the flesh of the animal. The attachment sheet 87 and the attachment nail 91 may be covered in a grease, which aids in the attachment of the pad 76 to the fur coat of the animal.

Figure 22:
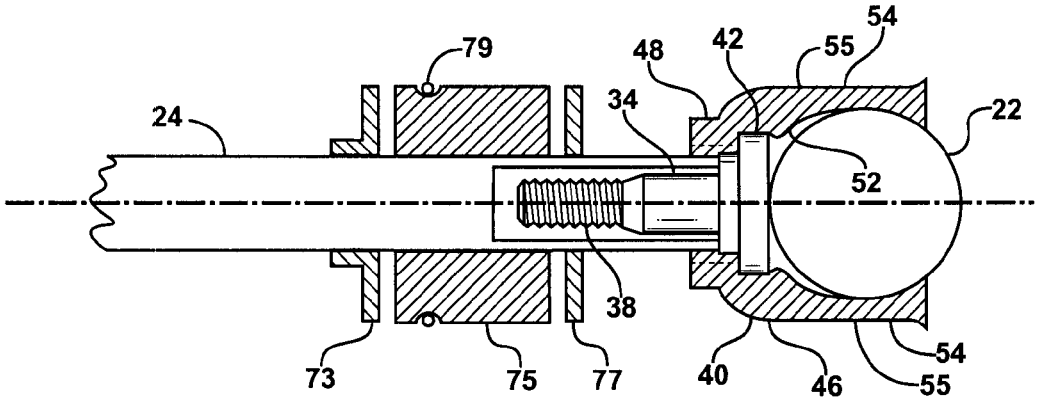
FIG. 22 is a cross sectional side view of an alternative embodiment of the media reservoir and an alternative embodiment of the energy dissipating device.

Referring to FIG. 22, an alternative embodiment of the media reservoir 46, along with an alternative embodiment of the energy dissipating device 72 are disclosed. The alternative embodiment of the media reservoir 46 is formed from a resilient material, such as a hard rubber, so as to not fracture upon impact. It should be understood that the alternative embodiment of the media reservoir 46 may include some other material that will not fracture upon impact with the surface, thereby permitting re-use of the media reservoir 46. The support 54 includes a wall 55 extending around an outer periphery of the base 48. Accordingly, the wall 55 defines the cavity 52 to be generally cup shaped, for supporting the marking media 22 therein. The base 48 of the media reservoir 46 is disposed about the flange 42 of the arrowhead connector 34 in a push fit connection. The alternative embodiment of the energy dissipating device 72 includes a first flat washer 73 disposed over the shaft 24 of the arrow 20 in a tight push fit connection so as to not slide over the shaft 24 of the arrow 20 upon impact. Alternatively, the first washer 73 may be otherwise rigidly attached to the shaft 24 of the arrow 20 by some other mechanically connection or adhered to the shaft 24 by a chemical adhesive. A cushion 75 is disposed over the shaft 24, between the first washer 73 and the media reservoir 46. The cushion 75 includes a resilient, compressible material, such as a rubber or a foam, for absorbing energy upon impact. A cable tie 79 (zip tie) secures the cushion 75 to the shaft 24. A second washer 77 is disposed over the shaft 24 between the cushion 75 and the media reservoir 46 to spread the force exerted upon the energy dissipating device 72 evenly over the cushion 75. The alternative embodiment of the energy dissipating device 72 is positioned along the shaft 24 so that the media reservoir 46 may move along the shaft 24, compressing the cushion 75, while not allowing the arrowhead connector 34 to contact the surface upon impact.

The foregoing invention has been described in accordance with the relevant legal standards; thus, the description is exemplary rather than limiting in nature. Variations and modifications to the disclosed embodiments may become apparent to those skilled in the art and do come within the scope of the invention. Accordingly, the scope of legal protection afforded this invention can only be determined by studying the following claims.

What is claimed is:

1. An arrow for remotely delivering a marking media to a location, said arrow comprising:

a shaft having a nock end and extending along a longitudinal axis to an opposing distal end;

a media reservoir including a base connected to said distal end of said shaft; and a plurality of supports extending outwardly from said base of said media reservoir along said longitudinal axis and defining a cavity for securing the marking media within said cavity between said plurality of supports in a press-fit connection;

said plurality of supports having a lip for engaging the marking media to retain the marking media between said plurality of supports wherein the marking media includes a spherical body defining a diameter and wherein said lips on said plurality of supports are spaced from said base a distance greater than one half the diameter of the spherical body with each of said lips disposed a distance less than the diameter of the spherical body from any other of said lips; wherein said plurality of supports include an interior curvilinear surface for cradling the spherical body between said curvilinear surfaces of said plurality of supports.

2. An arrow as set forth in claim 1 further comprising a cap attached to said media reservoir and further defining said cavity between said media reservoir and said cap.

3. An arrow as set forth in claim 2 wherein said cap includes a plurality of detents extending toward said plurality of supports and wherein each of said plurality of supports define a recess for receiving one of said plurality of detents in a snap fit connection.

4. An arrow as set forth in claim 2 further comprising a nose cone attached to said cap opposite said cavity for absorbing energy upon impact with a surface.

5. An arrow as set forth in claim 4 wherein said nose cone includes a resilient material.

6. An arrow as set forth in claim 1 further comprising an energy dissipating device for reducing an amount of energy transmitted to said shaft upon impact.

7. An arrow as set forth in claim 6 wherein said energy dissipating device is frangible upon impact.

8. An arrow as set forth in claim 7 wherein said energy dissipating device is disposed between said shaft and said media reservoir and includes an outer wall and at least one vein extending inward toward said longitudinal axis from said outer wall wherein said flange crushes said vein response to said shaft advancing forward into said energy dissipating device upon impact.

9. An arrow as set forth in claim 6 wherein said energy dissipating device includes a resilient material.

10. An arrow as set forth in claim 1 further comprising a pad attached to said media reservoir and further defining said cavity between said media reservoir and said pad.

11. An arrow as set forth in claim 10 wherein said pad includes a central portion and a plurality of wings extending from said central portion and said media reservoir includes a plurality of posts extending from said base along said longitudinal axis and including an upstanding ridge disposed on each of said plurality of posts for securing said plurality of wings to said plurality of posts.

12. An arrow as set forth in claim 10 wherein said pad includes an absorbent material.

13. An arrow as set forth in claim 10 further comprising an attachment device for attaching said pad to a surface.

14. An arrow as set forth in claim 13 wherein said attachment device includes a spherical housing supported between said plurality of supports in said media reservoir.

15. An arrow as set forth in claim 14 wherein said attachment device defines a central bore therethrough and includes a spike having a shank partially disposed within said central bore and presenting a point extending outward from said spherical housing and wherein said pad includes an opening for passing said shank of said spike therethrough.

16. An arrow as set forth in claim 13 wherein said attachment device includes an attachment sheet having a plurality of hooks for attaching said pad to an animal.

17. An arrow as set forth in claim 1 further comprising an arrowhead connector interconnecting said media reservoir and said shaft.

18. An arrow as set forth in claim 17 wherein said arrowhead connector includes aluminum.

19. An arrow as set forth in claim 18 wherein said arrowhead connector includes a flange extending radially therefrom and including a thickness of at least one tenth of an inch.

20. An assembly as set forth in claim 19 further comprising a pad attached to said media reservoir and further defining said cavity between said media reservoir and said pad.

21. An assembly as set forth in claim 20 wherein said pad includes a central portion and a plurality of wings extending from said central portion and said media reservoir includes a plurality of posts extending from said base along said longitudinal axis and including an upstanding ridge disposed on each of said plurality of posts for securing said plurality of wings to said plurality of posts.

22. An assembly as set forth in claim 20 wherein said pad includes an absorbent material.

23. An assembly as set forth in claim 20 further comprising an attachment device for attaching said pad to a surface.

24. An assembly as set forth in claim 23 wherein said attachment device includes a spherical housing supported between said plurality of supports within said cavity.

25. An assembly as set forth in claim 24 wherein said attachment device defines a central bore therethrough and includes a spike having a shank partially disposed within said central bore and presenting a point extending outward from said spherical housing and wherein said pad includes an opening for passing said shank of said spike therethrough.

26. An assembly as set forth in claim 23 wherein said attachment device includes an attachment pad having a plurality of hooks for attaching said pad to an animal.

27. An arrow as set forth in claim 1 wherein said marking media includes a paint ball.

28. An arrow as set forth in claim 1 wherein said marking media includes a scent ball.

29. An arrowhead assembly for remotely delivering a marking media to a location by an arrow having a shaft, said assembly comprising:

an arrowhead connector for coupling to the shaft of the arrow;

a media reservoir including a base coupled to said arrowhead connector; and a plurality of supports extending outwardly from said base of said media reservoir along a longitudinal axis and defining a cavity for securing the marking media within said cavity between said plurality of supports in a press-fit connection;

said plurality of supports having a lip for engaging the marking media to retain the marking media between said plurality of supports wherein the marking media includes a spherical body defining a diameter and wherein said lips on said plurality of supports are spaced from said base a distance greater than one half the diameter of the spherical body with each of said lips disposed a distance less than the diameter of the spherical body from any other of said lips; wherein said plurality of supports include an interior curvilinear surface for cradling the spherical body between said curvilinear surfaces of said plurality of supports.

30. An assembly as set forth in claim 29 further comprising a cap attached to said media reservoir and further defining said cavity between said media reservoir and said cap.

31. An assembly as set forth in claim 30 wherein said cap includes a plurality of detents extending toward said plurality of supports and wherein each of said plurality of supports define a recess for receiving one of said plurality of detents in a snap fit connection.

32. An assembly as set forth in claim 30 further comprising a nose cone attached to said cap opposite said cavity for absorbing energy upon impact with a surface.

33. An assembly as set forth in claim 32 wherein said nose cone includes a resilient material.

34. An assembly as set forth in claim 29 further comprising energy dissipating device for reducing an amount of energy transmitted to said shaft upon impact.

35. An assembly as set forth in claim 34 wherein said energy dissipating device is frangible upon impact.

36. An assembly as set forth in claim 35 wherein said energy dissipating device is disposed between said shaft and said media reservoir and includes an outer wall and at least one vein extending inward toward said longitudinal axis from said outer wall wherein said flange crushes said vein in response to said shaft advancing forward into said energy dissipating device upon impact.

37. An assembly as set forth in claim 34 wherein said energy dissipating device includes a resilient material.

38. An assembly as set forth in claim 29 wherein said arrowhead connector includes aluminum.

39. An assembly as set forth in claim 38 wherein said arrowhead connector includes a flange extending radially therefrom and including a thickness of at least one tenth of an inch.

40. An assembly as set forth in claim 29 wherein said marking media includes a paint ball.

41. An assembly as set forth in claim 29 wherein said marking media includes a scent ball.

* * * * *

UNITED STATES PATENT AND TRADEMARK OFFICE

CERTIFICATE OF CORRECTION

PATENT NO. : 7,601,084 B2
APPLICATION NO. : 11/470669
DATED : October 13, 2009
INVENTOR(S) : John C. Martin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 311 days.

Signed and Sealed this

Fifth Day of October, 2010

David J. Kappos

David J. Kappos
*Director of the United States Patent and Trademark Office*